US008960175B2

(12) United States Patent
Wood

(10) Patent No.: US 8,960,175 B2
(45) Date of Patent: Feb. 24, 2015

(54) PAINTBALL MARKER WITH ADVANCED GAS RELEASE MECHANISM

(71) Applicant: Planet Eclipse Limited, Trafford Park, Manchester (GB)

(72) Inventor: Jack Kingsley Wood, Chelford (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 49 days.

(21) Appl. No.: 13/869,478

(22) Filed: Apr. 24, 2013

(65) Prior Publication Data

US 2013/0291848 A1 Nov. 7, 2013

Related U.S. Application Data

(60) Provisional application No. 61/641,403, filed on May 2, 2012.

(51) Int. Cl.
*F41B 11/32* (2006.01)
*F41B 11/723* (2013.01)

(52) U.S. Cl.
CPC ..... *F41B 11/723* (2013.01)
USPC ..... 124/73; 124/71

(58) Field of Classification Search
CPC ..... F41B 11/723; F41B 11/72; F41B 11/62; F41B 11/60
USPC ..... 124/71, 73–77, 56
See application file for complete search history.

(56) References Cited

U.S. PATENT DOCUMENTS

| | | | | |
|---|---|---|---|---|
| 6,302,092 | B1 * | 10/2001 | Juan | 124/31 |
| 6,349,711 | B1 * | 2/2002 | Perry et al. | 124/73 |
| 6,763,822 | B1 * | 7/2004 | Styles | 124/77 |
| 6,889,681 | B1 * | 5/2005 | Alexander et al. | 124/72 |
| 6,889,682 | B2 * | 5/2005 | Styles et al. | 124/77 |
| 7,045,726 | B1 * | 5/2006 | Yeh | 200/81 R |
| 7,275,530 | B2 * | 10/2007 | Deak | 124/73 |
| 7,490,598 | B2 * | 2/2009 | Rice | 124/77 |
| 7,621,265 | B2 * | 11/2009 | Halmone | 124/74 |
| 7,967,000 | B2 * | 6/2011 | Walker et al. | 124/73 |
| RE44,328 | E * | 7/2013 | Chen | 124/77 |
| 2003/0085370 | A1 * | 5/2003 | Juan | 251/12 |
| 2004/0144377 | A1 * | 7/2004 | Dobbins | 124/74 |

(Continued)

FOREIGN PATENT DOCUMENTS

| | | | |
|---|---|---|---|
| DE | 20200717818 | U1 | 2/2008 |
| EP | 2317275 | A2 | 5/2011 |

*Primary Examiner* — Bret Hayes
*Assistant Examiner* — Joshua Freeman
(74) *Attorney, Agent, or Firm* — Barlow, Josephs & Holmes, Ltd.

(57) ABSTRACT

A projectile launching device has a knock-open valve that is opened when forced by a hammer to release compressed air and launch a projectile from the device. The projectile launching device has a force control device between the hammer and the knock-open valve that is configured and positioned to provide force translation and control, allowing forces acting on a knock-open valve to be manipulated independently of the speed profile and mass of the hammer. A bolt is used to load a projectile into the barrel before it is launched. Where the hammer is configured to move with the bolt, the force control device allows forces acting on a knock-open valve to be manipulated independently of the speed profile and mass of the hammer and the bolt. The force control device can be a cam surface or a lever, or a lever having a cam surface.

5 Claims, 8 Drawing Sheets

(56) References Cited

U.S. PATENT DOCUMENTS

| | | | | |
|---|---|---|---|---|
| 2004/0237954 | A1* | 12/2004 | Styles et al. | 124/77 |
| 2006/0107937 | A1* | 5/2006 | Rice | 124/73 |
| 2006/0107938 | A1* | 5/2006 | Rice | 124/73 |
| 2006/0107939 | A1* | 5/2006 | Dobbins | 124/73 |
| 2006/0231084 | A1* | 10/2006 | Styles et al. | 124/74 |
| 2007/0163563 | A1* | 7/2007 | Gan | 124/73 |
| 2008/0011284 | A1* | 1/2008 | Styles et al. | 124/77 |
| 2008/0060630 | A1* | 3/2008 | Halmone | 124/73 |
| 2009/0114201 | A1* | 5/2009 | Halmone | 124/74 |
| 2009/0283083 | A1 | 11/2009 | Liao | |
| 2013/0263840 | A1* | 10/2013 | Maeda | 124/76 |

* cited by examiner

PAINTBALL MARKER WITH ADVANCED GAS RELEASE MECHANISM

CROSS REFERENCE TO RELATED APPLICATION

This application is related to and claims priority to earlier filed U.S. provisional patent application 61/641,403, filed May 2, 2012, the entire contents thereof is incorporated herein by reference.

BACKGROUND OF THE INVENTION

The invention relates generally to paintball markers and air soft guns and the gameplay related thereto. The sport of paintball is very well known and includes the use of a paintball marker or gun to pneumatically launch a rubber ball or a ball that is typically filled with a colored liquid. For air soft, plastic projectiles are shot at opposing players. Each of the players in the game has such a marker or gun so they can launch projectiles toward players on the opposing team. When players on the opposing team are marked or hit with a projectile, there is typically a scoring event.

The present invention is particularly related to the game of paintball and the related paintball markers. Therefore, the invention will be discussed in detail in connection with paintball markers for ease of illustration but it should be understood that the present invention is applicable to the air soft sport and air soft guns as well.

It is well known in the art of paintball markers that a burst of stored gas is released from a storage reservoir by opening some type of valve assembly to launch a projectile, such as a paintball. Such a valve assembly is typically opened via the actuation of a trigger assembly to open the valve assembly for launch. For this purpose, some types of paintball markers employ a "knock-open 2-2" valve mechanism to release the burst off gas that accelerates the projectile down the barrel for launch. They typically utilize a pneumatic cylinder as a "hammer" mechanism to "knock" or "actuate" the valve open in order to release gas from the storage reservoir in order to launch a projectile from the paintball marker. For ease of reference, the pneumatic cylinder or other structure for actuating the valve is generally referred to as a "hammer" herein.

This mechanism is also used in other kinds of launching devices. For example, such a mechanism may be used with Airsoft type guns.

In many of these paintball markers the bolt mechanism and the hammer mechanism are mechanically linked so that they move in unison to simultaneously load a projectile into the barrel and then open the knock-open valve mechanism. This is preferred as it simplifies two separate mechanisms into one combined element in the system. The speed and direction in which the bolt and hammer move are the same. This results in the knock-open valve mechanism being opened with the same speed as the bolt and hammer are moving at, which is at the point that the hammer and bolt mechanism strikes the knock-open valve. Thus, the force acting on the knock-open valve mechanism is proportional to the speed and mass of the combined bolt and hammer mechanism.

With the prior art there is no way to alter the force acting on the knock-open valve mechanism without altering either the speed or the mass of the bolt and hammer mechanism. In prior art there are no elements within the system that can be altered to either increase or decrease the force acting on the valve mechanism without altering the speed and/or the mass of the hammer and bolt mechanism. The fact that the force acting on the valve is fixed to the mass of the hammer and bolt mechanism can create problems and presents limitations in the operation and construction of the marker. Most notably, current systems make it impossible to customize the force acting on the valve independently from the speed and/or mass of the hammer and bolt mechanism and vice versa.

Therefore, there is a need for an advanced gas release system that can achieve such independent control of the force acting on the valve separately to the speed and/or mass of the hammer and bolt mechanism.

There is a need for an advanced gas release system that can achieve the aforesaid independent control while still providing superior launch control.

SUMMARY OF THE INVENTION

The present invention preserves the advantages of prior art gas release mechanisms for paintball markers and airsoft guns accessories and adds thereto. In addition, it provides new advantages not found in currently available gas release systems.

The present invention provides a new advanced gas release mechanism that includes a new force transfer and control element between the valve mechanism and the hammer mechanism. The new element allows the forces acting on the valve mechanism to be manipulated completely independently of the bolt/hammer speed and mass. The new element can be any type of force translation mechanism or configuration but is, preferably, either a lever or a cam. The valve, lever or cam and bolt/hammer may be in any orientation and in any plane in respect to both each other and the vector of the projectile being loaded and fired. The principle is to utilize mechanical advantage to alter the force profile at the valve mechanism in relationship to the hammer/bolt force profile.

Therefore, it is an object of the present invention to provide a gas release mechanism that can permit the force acted on the valve to be independently controlled compared to the speed and mass of the bolt/hammer mechanism.

There is a further object of the present invention to provide a gas release mechanism that has superior performance while providing the independent control of the forces delivered to the valve mechanism and the hammer/bolt mass and speed.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
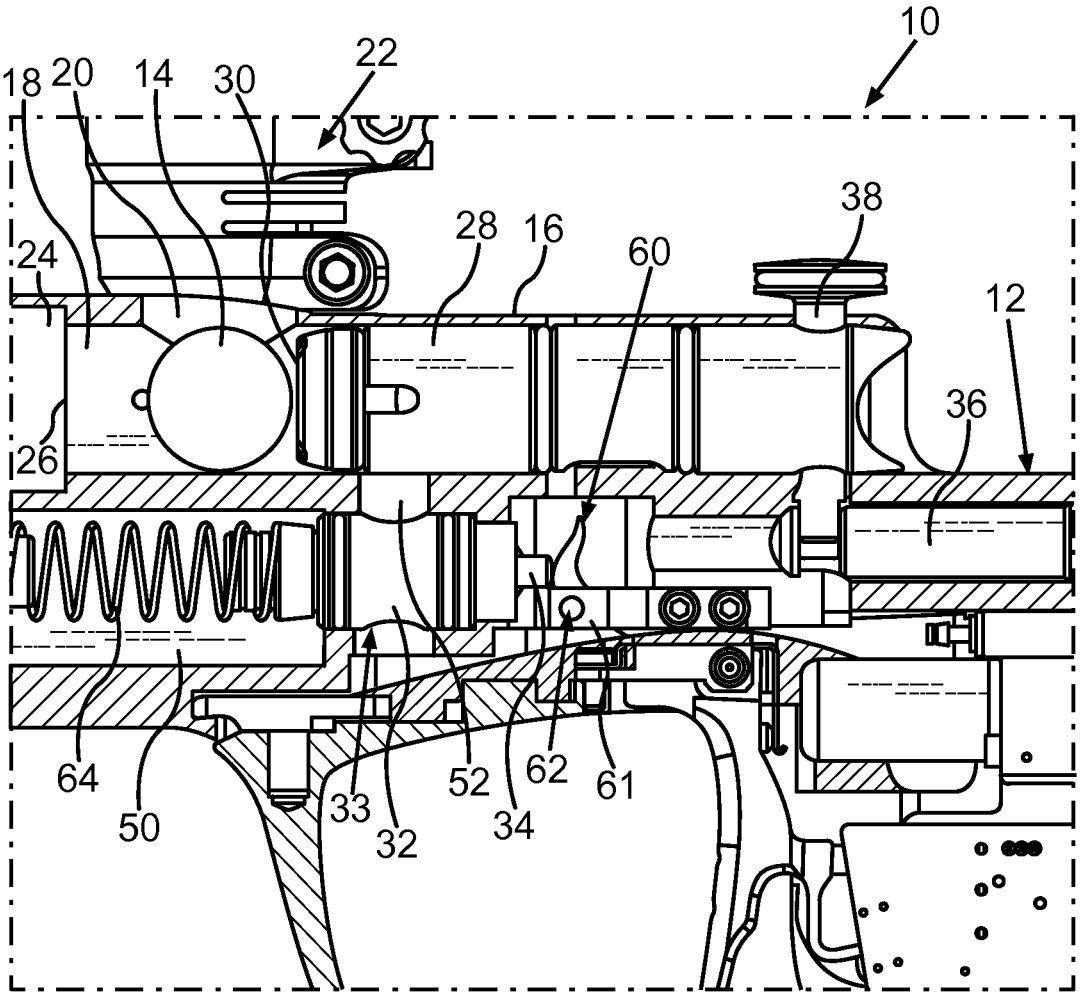
FIG. 1 is a cross-sectional view of the a paintball marker employing the gas release mechanism of the present invention in the state of projectile loading.

Referring now to the drawings, the paintball marker with advanced gas release mechanism is illustrated and generally indicated at 10 in FIGS. 1-8. As will be more fully described, the instant paintball marker with advanced gas release mechanism provides a force control device that can be used to modify and finely control the force applied to a knock-open valve, generally referred to as 33, or also known as an exhaust valve, used to fire the projectiles.

The present invention, shown in FIG. 1, provides a projectile launching device 12 that can be used to launch paintball or another projectile 14. The device 12 has a main body 16 including a breech 18 and a feed port 20 that are configured for accommodating and launching a projectile 14. A hopper 22 for dispensing projectiles may be secured to the projectile launching device 12 so that it can dispense projectiles into the breech 18 through the feed port 20 when the device is in the loading position, as shown in FIG. 1.

In front of the breech 18, a barrel 24 is connected to the main body 16 and allows the user to control the direction of a projectile 14 fired from the device 12. The barrel 24 has a front portion with an opening through which a projectile may exit the device 12, and a rear portion 26 that has an opening that engages with the breech 18.

Figure 2:
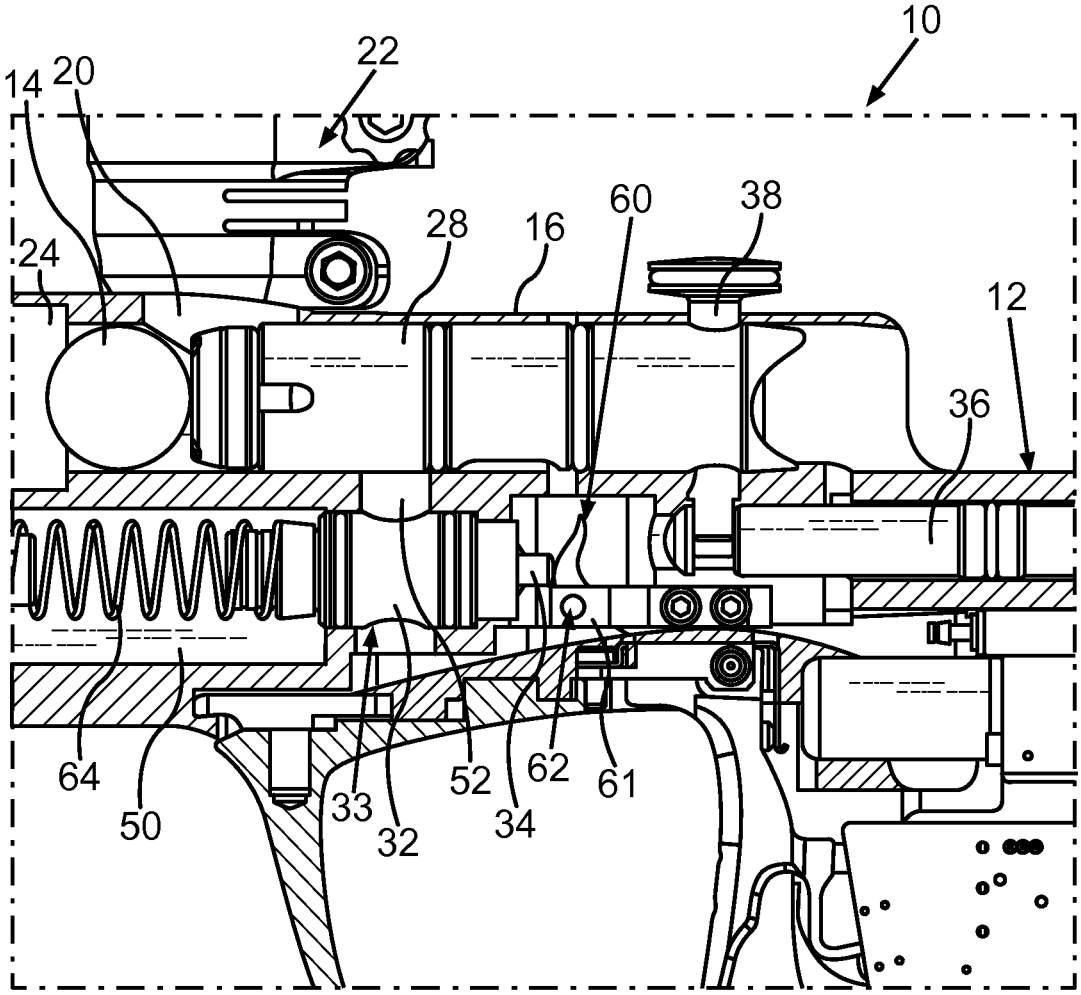
FIG. 2 is a cross-sectional view of the a paintball marker employing the gas release mechanism of the present invention in the state of projectile loading showing initial movement of the hammer and bolt together.

To facilitate launching of a projectile 14 from the device 12, a bolt 28 located rearwardly from the breech 18 is slidably mounted within the device 12 so that it can move a projectile 14 from the breech 18 into the barrel 24. FIGS. 1-4 show this movement of the bolt 28 within the device 12 to move a projectile 14 into the barrel 24. The bolt 28 is movable from a loading position, as shown in FIG. 1, in which a projectile may be moved from the hopper 22 into the breech 18, and a launching position, as shown in FIG. 4, in which the bolt 28 extends through the breech 18. When a projectile 14 is loaded in the breech 18 and the bolt 28 moves from the loading position to the launching position, a front surface 30 on the bolt 28 moves a projectile 14 from the breech 18 into the barrel 24, where it may be launched, as can be seen in FIG. 2.

Figure 6:
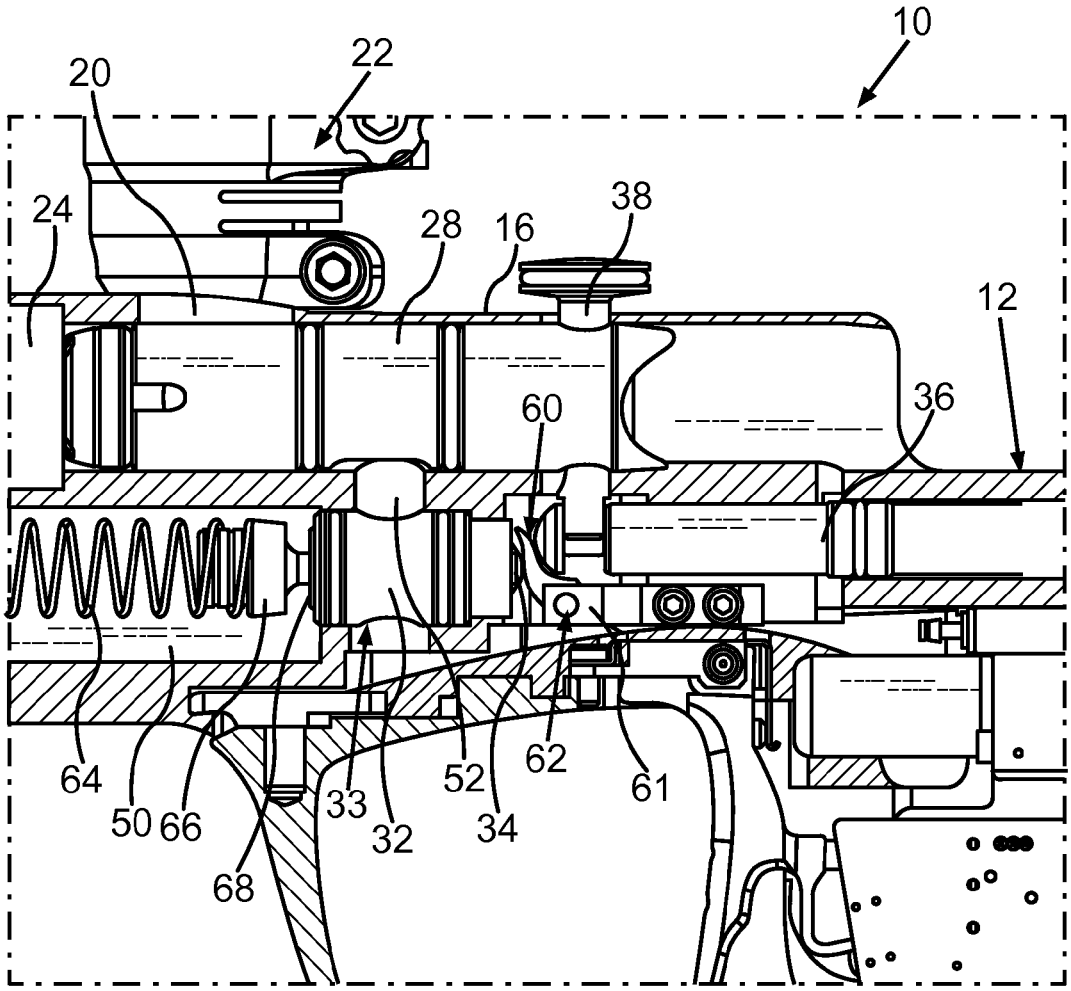
FIG. 6 is a cross-sectional view of the paintball marker employing the gas release mechanism of the present invention showing maximum forward movement of the hammer and bolt together with the leading end of the hammer making full contact with the cam to fully open the exhaust valve with the cam fully pivoted.

The projectile 14 is then launched from the device 12 using compressed air. A valve guide structure 32 of knock-open valve 33, described in more detail below, controls and directs the compressed air supply within the device 12. Valve pin 34 is movable from a spring biased sealing position, as shown in FIG. 1, in which it does not allow air to pass through the valve guide structure 32, and an open position, as shown in FIG. 6, in which air may pass through the valve guide structure 32 in order to launch a projectile 14 from the device 12. The configuration of the knock-open valve 33 can also be seen in FIG. 8. When a user is ready to launch a projectile 14 from the device 12, the user may trigger a hammer 36 to strike the valve pin 34 of knock-open valve 33 so that it is moved to the open position. The hammer 36 may be connected to the bolt 28 so that movement of the bolt results in simultaneous movement of the hammer. FIG. 1 shows how a bolt pin 38 running transversely through the bolt 28 and the hammer 36 can be used to link the movement of the hammer 36 and the bolt 28. The operation of the valve guide 32, valve pin 34, and hammer 36 are described in more detail below.

The present invention greatly improves prior art projectile launching devices by including a further translation element 60 into the system between the valve mechanism 33 and the hammer mechanism to provide force translation and control. This new element 60 allows the forces acting on the valve mechanism 33 to be manipulated completely independently of the bolt/hammer speed and mass. The new element 60 can be either a lever, or a cam, or a lever with a cam surface, as shown in FIGS. 1-8. The principle is to utilize mechanical advantage to alter the force profile at the valve mechanism 33 in relationship to the hammer/bolt force profile. The present invention shows just one example of a further element 60 that provides force translation control within a projectile launching device. Other devices and structures may be used and still be within the scope of the present invention.

Figure 3:
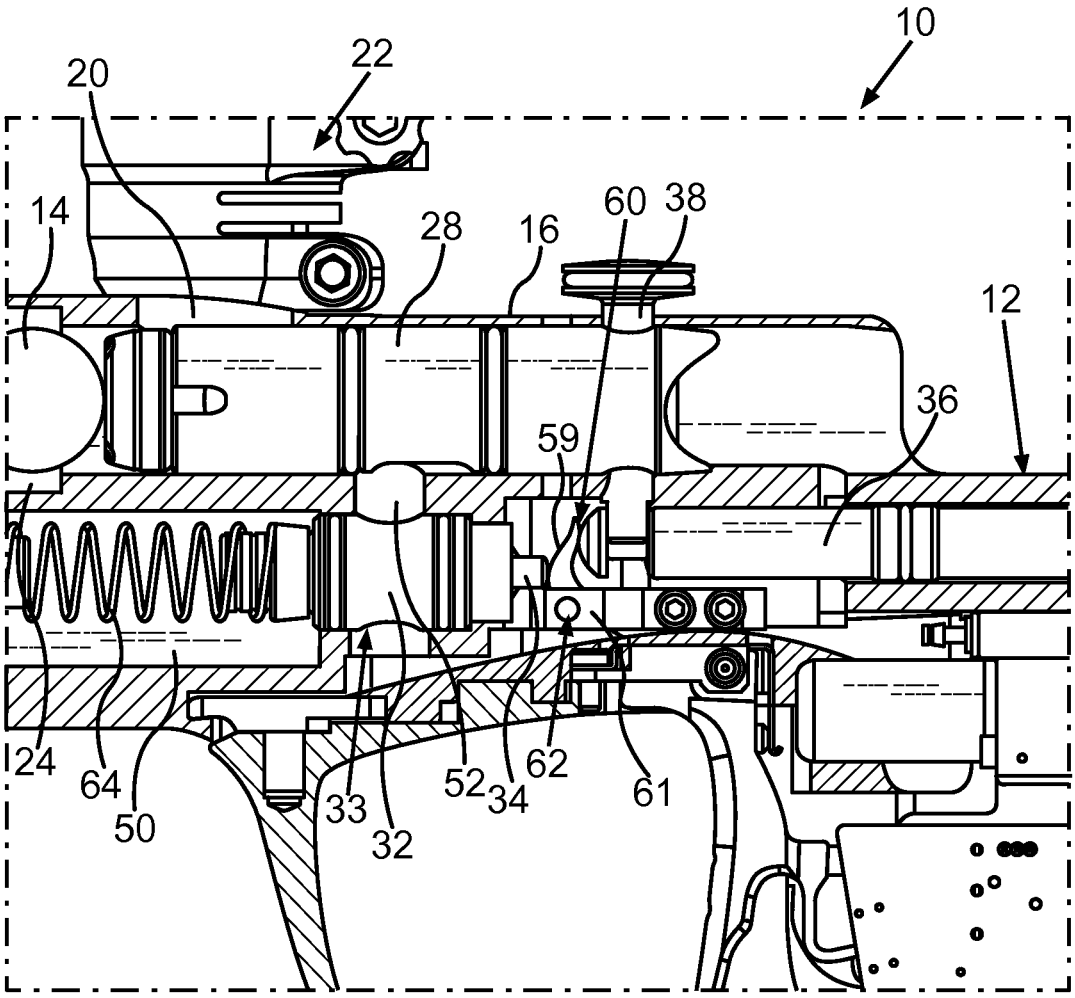
FIG. 3 is a cross-sectional view of the paintball marker employing the gas release mechanism of the present invention showing further movement of the hammer and bolt together with the leading end of the hammer making an initial contact with the cam of the gas release mechanism of the present invention.
Figure 4:
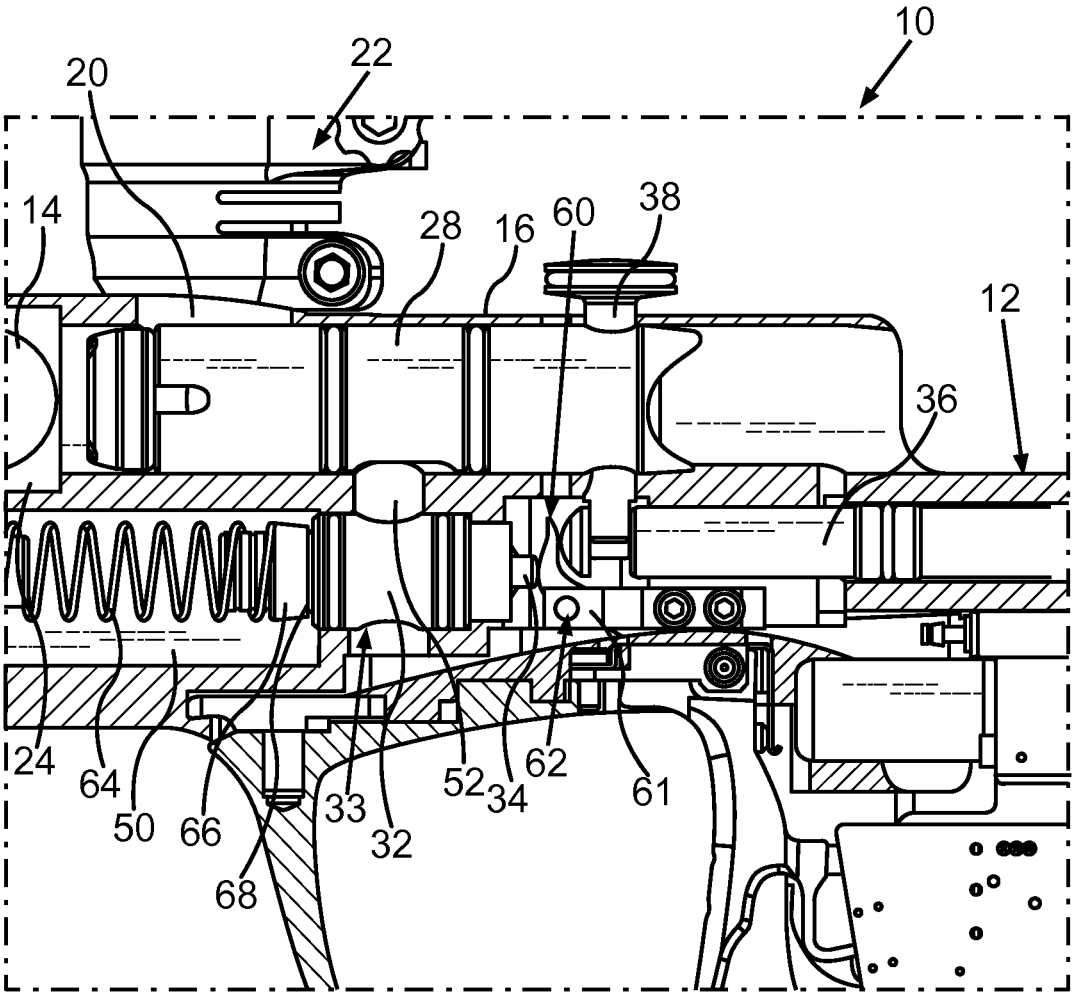
FIG. 4 is a cross-sectional view of the paintball marker employing the gas release mechanism of the present invention showing further movement of the hammer and bolt together with the leading end of the hammer making contact with the cam to start to open the exhaust valve with the cam starting to pivot.
Figure 5:
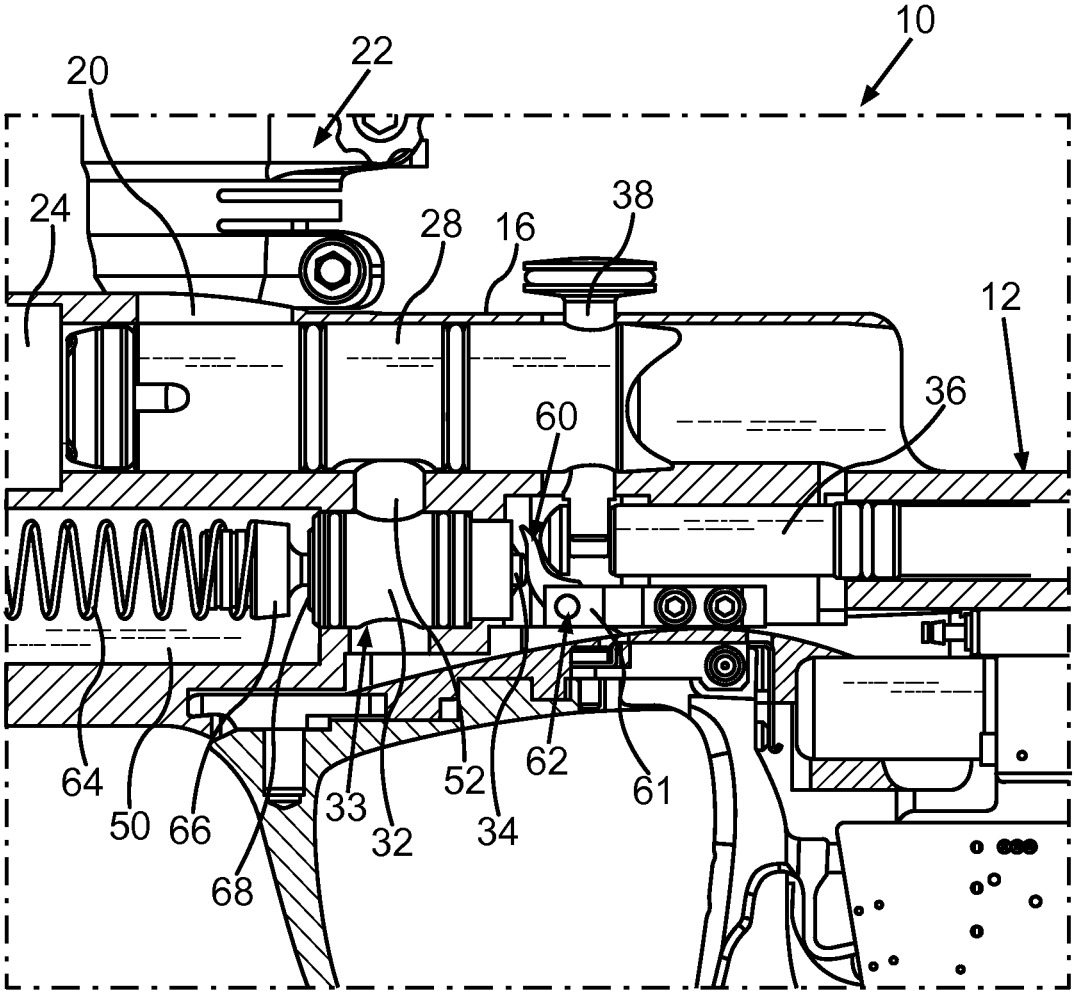
FIG. 5 is a cross-sectional view of the paintball marker employing the gas release mechanism of the present invention showing even further movement of the hammer and bolt together with the leading end of the hammer making contact with the cam to even further open the exhaust valve with further pivoting of the cam.

As shown in FIG. 3, a translation element 60, in the configuration of a lever, is secured to the main body 16 at a pivot 62 by a cam holder 61. As the hammer 36 is moved towards the valve pin 34 of the knock-open valve 33, the hammer 36 contacts a point on the lever cam 60 that is further away from the pivot point 62 of the lever cam 60 than the point at which the valve pin 34 contacts the other side of the lever cam 60. Thus, when the hammer 36 is forced progressively to the left, as shown in FIGS. 3-6, it rotates the lever 60 counterclockwise about the pivot point 62. The lever 60 then pushes the valve pin 34 to the left through the valve guide 32, but the displacement of the valve pin 34 and thus the knock-open valve 33 as a whole is less than the displacement of the hammer 36 because the valve pin 34 contacts the lever 60 closer to the pivot point 62 than the hammer 36 does.

The cam surfaces on the lever 60 also help reduce the displacement of the valve pin 34 of knock-open valve 33 relative to the hammer 36. The left surface of the lever 60 in FIGS. 3-6 is shown as a convex surface 59, with the leftmost part of the convex surface 59 in contact with the valve pin 34. Counterclockwise rotation of the lever 60 tends to push the valve pin 34 to the left, but the convex front surface 59 of the lever offsets that to some degree.

By inference, it can be seen that the lever 60 or cam can also be arranged so that the speed at which the valve 33 opens, via movement of the valve pin 34, can be controlled independently of the hammer/bolt speed.

The speed that the valve 33 opens from movement of the valve pin 34 at can be finely controlled by a cam "profile" or other profile, shape or configuration of the translation element employed, or by altering the distance of the hammer 36 and the valve pin 34 from the pivot point of a lever 60. Thus, the force is translated and altered, e.g. reduced or even increased, if desired, by use of the interim element 60. FIGS. 1-6, attached, show the entirety of the travel of the hammer/follower and bolt 28, travelling in unison due to interconnection using a pin bolt, from a resting rearward position stepped through to full opening of the knock-open valve 33 but full movement of valve pin 34 as controlled by the lever mechanism 60 of the present invention. In this case, it can be seen, such as in FIG. 4-6 how the movement of the valve pin 34 is decreased and force imparted by the hammer/follower is increased via the pivoting of the lever element 60. The length of the lever 60 and profile shape control the force delivered to the exhaust valve 34. These parameters can also control the amount of force delivered over the course of travel. Here, the S-shaped lever arm 60 further helps control and customize the delivery of force, travel and rate that the valve pin 34 moves and, as a result, the knock-open valve 33 opens. Other shapes can be used to achieve different force profiles over time, as desired.

The hammer 36, serving as an actuator, and bolt 28 mechanism can be driven by numerous methods. In the prior art, the hammer 36 and bolt 28 are actuated by pneumatic force or spring force, but it is envisioned that the hammer 36 and bolt 28 could be actuated by magnetic force, electromagnetic force, ball screw, piezoelectric actuator, linear motor, hydraulics or any other type of motive force. For example, the hammer 36 is preferably a pneumatic cylinder. Also, the hammer 36, serving as an actuator, can be linear or rotary in nature.

The knock-open valve 33 is generally made up of a valve guide 32 with a valve pin 34 and valve seal 66 spring-biased to a closed/sealed position. The knock-open valve 33 and valve sealing face 68 on the valve guide 32 completes the sealing structure. The valve pin 34 of valve 33 can be held or biased towards the closed position in a number of ways including with air or a spring. The spring 64 may be a coil spring, or another type of spring. The closing force can be applied at either end of the valve 33 or valve guide 32. FIGS. 1-8 show a coil spring 64 applying the closing force on the left side of the valve 33.

Figure 7:
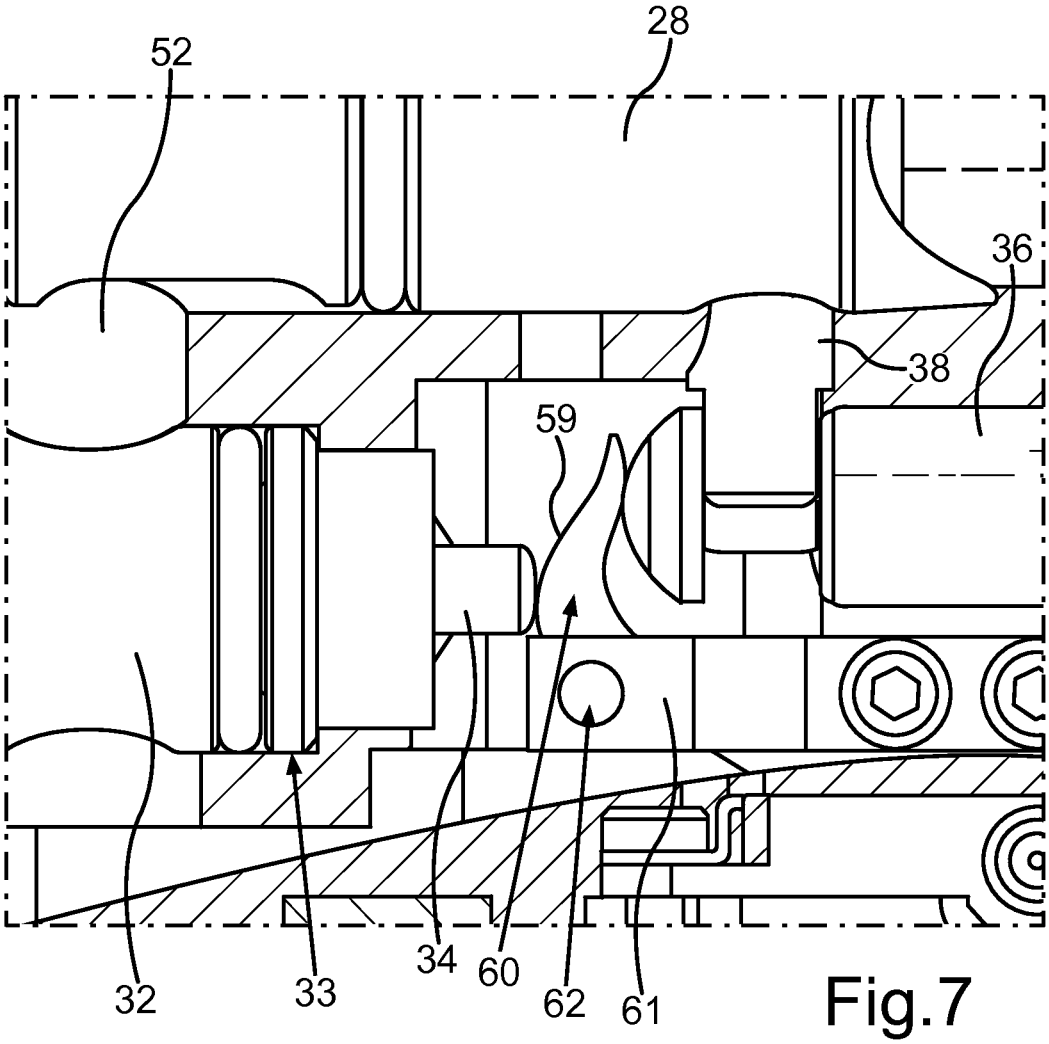
FIG. 7 shows a close-up partial cross-sectional view of a marker using the gas release mechanism of the present invention.
Figure 8:
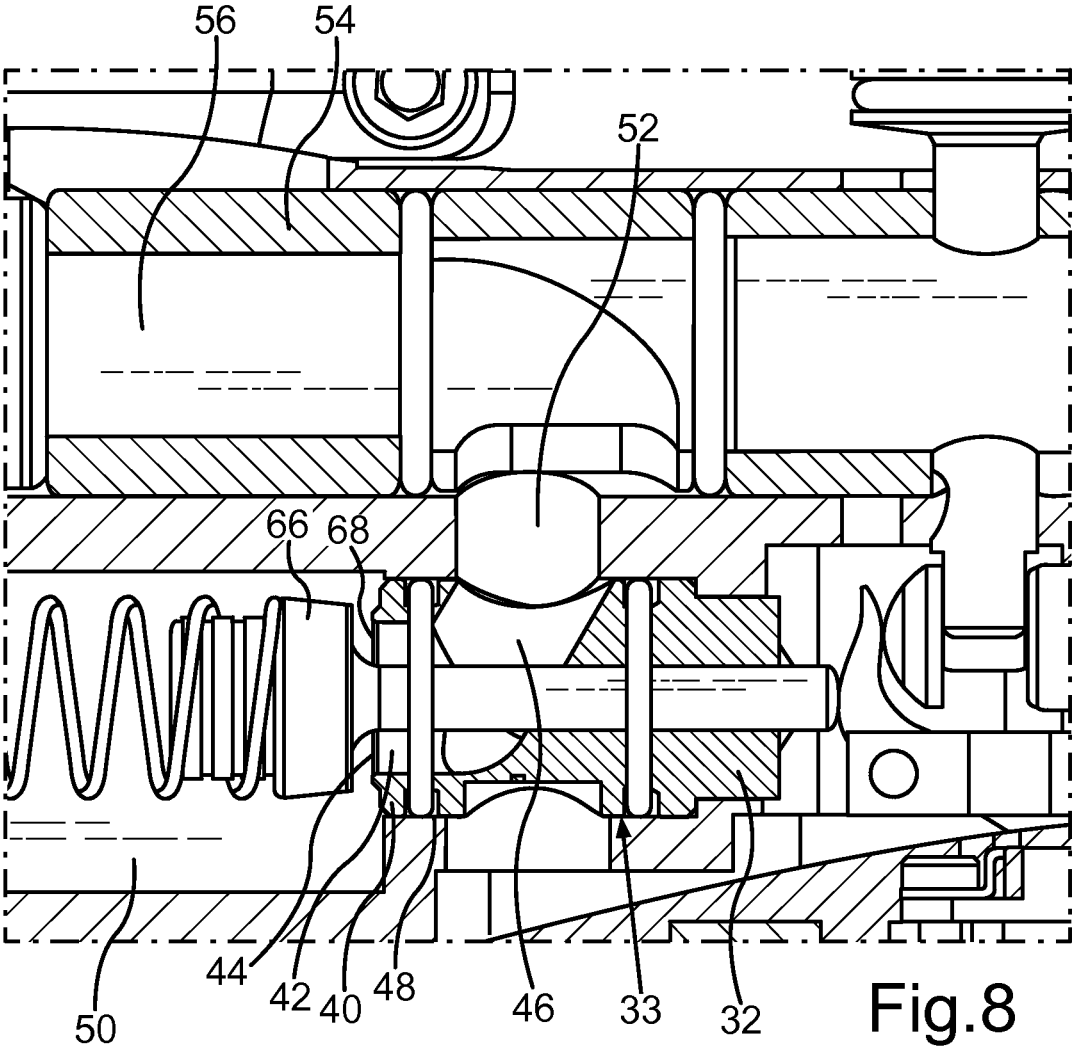
FIG. 8 shows a partial cross-sectional view of a marker, with the valve guide shown in cross-sectional, using the gas release mechanism of the present invention.

Specific details of a marker equipped with the advanced gas release mechanism of the present invention are shown in FIGS. 7 and 8. FIG. 8 shows how the internal structure of the valve guide 32 directs compressed air. The valve guide 32 has an outer valve guide wall 40 that defines a valve guide transfer port 42. The valve guide transfer port 42 has a first end 44 and a second end 46. The first end 44 of the valve guide transfer port 42 is seated in an opening 48 in a valve chamber 50 containing compressed air. The second end engages a first opening of a body transfer port 52 defined in the main body 16. The bolt 28 has an outer wall 54 that defines a bolt transfer port 56 extending from a first opening to a second opening within the bolt 28. The body transfer port has a second opening that is aligned with the first bolt opening when the bolt 28 is in the launching position, as shown in FIG. 8. Together, the valve guide transfer port 42, the body transfer port 52, and the bolt transfer port 56 provide a path for compressed air to be delivered from the valve chamber 50 to the barrel 24 in order to launch the projectile 14 from the barrel 24, as shown in FIG. 8.

The knock-open valve 33 and the path of travel of valve pin 34 are also generally in the same orientation as the bolt 28 and hammer 36. These are normally operated on parallel planes to that of the breech 18 and barrel 24. However, it is envisioned that that through the use of a lever or cam mechanism 60 as disclosed in this invention, the valve 33, bolt 28 and hammer 36 need not be in the same orientation, the same plane or on the same axis as each other or the barrel and breech.

It is also envisioned that a similar lever or cam actuated valve of the present invention could be used in a system where the bolt and the hammer act and move independently of each other. This valve could be in any orientation within the marker and the cam/lever could be operated by pneumatics, electromagnetics, magnetism, hydraulics, piezo-actuator, stepper motor, linear actuator or any other force-generating element. Equally the bolt could be independently controlled by pneumatics, electromagnetics, magnetism, hydraulics, piezo-actuator, stepper motor, linear actuator or any other force-generating element.

In view of the foregoing, a new and novel advanced gas release system is provided that can enable the force delivered to the valve mechanism to be independently controlled compared to the speed and/or mass of the hammer and bolt mechanism.

It would be appreciated by those skilled in the art that various changes and modifications can be made to the illustrated embodiments without departing from the spirit of the present invention. All such modifications and changes are intended to be covered by the appended claims.

What is claimed is:

1. A projectile launching device for launching projectiles, comprising:

a main body including a breech and a feed port configured for accommodating and launching projectiles;

a barrel connected to the main body, the barrel having a front portion and a rear portion, the rear portion of the barrel being connected to the breech, the front portion of the barrel being open so that a projectile may be launched from the barrel;

a valve for controlling a compressed air supply for launching projectiles from the barrel; the valve being movable between an open position and a closed position;

an actuator mounted within the body having a mass and a speed profile, the actuator positioned and configured to provide a force based on the mass and speed profile to move the valve from the closed position to the open position;

a force control member positioned between the actuator and the valve such that the actuator contacts the force control member and then the force control member contacts the valve to provide force translation and control that allows the force acting on the valve to be manipulated completely independently of the speed profile and mass of the actuator.

2. The projectile launching device of claim 1, wherein the force control member is a lever.

3. The projectile launching device of claim 1, wherein the force control member is a cam.

4. The projectile launching device of claim 1, wherein the actuator is a pneumatic cylinder.

5. The projectile launching device of claim 1, wherein the valve is a knock-out valve.

* * * * *